United States Patent [19]

Norlin

[11] Patent Number: 4,993,458

[45] Date of Patent: Feb. 19, 1991

[54] INTERMITTENT WHIP ROLL BRAKING DEVICE

[75] Inventor: Göran Norlin, Almhult, Sweden

[73] Assignee: Almhults Bruk AB, Almhult, Sweden

[21] Appl. No.: 372,418

[22] Filed: Jun. 28, 1989

[30] Foreign Application Priority Data

Jun. 28, 1988 [SE] Sweden ..... 8802404

[51] Int. Cl.[5] ..... D03D 49/04

[52] U.S. Cl. ..... 159/114

[58] Field of Search ..... 139/114, 110, 100, 109, 139/115, 25

[56] References Cited

U.S. PATENT DOCUMENTS 1,118,430 11/1914 Lacey .
2,951,509 9/1960 Pfarrwaller .
3,727,646 4/1973 Mares et al. .
3,871,418 3/1975 Hintsch ..... 139/100
3,929,168 12/1975 Filter et al. ..... 139/100 X
4,235,260 11/1980 Selivanov et al. .
4,485,849 12/1984 Franks ..... 139/109
4,827,985 5/1989 Sugita et al. ..... 139/110

*Primary Examiner*—Andrew M. Falik
*Attorney, Agent, or Firm*—Pollock, Vande Sande & Priddy

[57] ABSTRACT

A weaving machine operates with warp thread tracks which lead from warp beams towards a shuttle race at which a fell of the cloth can be established and the weft thread or weft threads can be drawn in with a reed during ongoing weaving. Immediately before the interaction of the reed with the weft thread or weft threads, a momentary friction or increase in friction is produced between the warp threads and a member arranged in the warp thread track between the magazine and the fell of the cloth. The friction or increase in friction is produced by brake members which are activated such that a reduction is achieved in the flexibility of the warp threads at the fell of the cloth during the interaction between the reed and the weft thread or weft threads.

15 Claims, 2 Drawing Sheets

INTERMITTENT WHIP ROLL BRAKING DEVICE

BACKGROUND OF THE INVENTION

1. Technical Field

The present invention relates to an arrangement for a weaving machine which operates with one or more warp thread tracks which lead from warp thread magazines towards a transverse shuttle race. At the latter a fell of the cloth is established by means of one or more shuttles, and each weft thread or weft threads can be drawn in with the reed during ongoing weaving.

2. Description of Related Art

In this type of weaving machine it is previously known to let the warp thread track run across one or more whip rolls and one or more auxiliary back beams. It is also known to design each whip roll and auxiliary back beam so as to be rotatable by the warp threads, which affords advantages from the point of view of thread tension. By virtue of the rotation of the whip roll and the auxiliary back beam it is easy, in contrast to the case with fixed, non-rotating whip rolls and auxiliary back beams, to control the feed of the warp threads from the warp beam or warp magazine concerned, so that the thread tension in the warp threads is maintained essentially constant during the entire weaving process.

The known apparatuses are disadvantages when used to weave high-quality cloths or cloths of material which is sensitive from the point of view of weaving. The rotation of each whip roll and/or auxiliary back beam results in the resistance of the warp thread, as a result of the drawing-in force of the reed towards the fell of the cloth during each weaving pick, being effected by the warp beam/magazine. The warp thread track between the warp beam and the fell of the cloth is comparatively long, and the arrangement, together with the fact that the warp threads themselves have a certain stretchability/elasticity, results in a flexibility/resilience of the warp threads when the reed is pressed against the fell of the cloth and the return of the fell of the cloth to a position determined by the elasticity of the warp thread system, as soon as the pressing force of the reed ceases, etc.

The above spring negatively effect resulting from the elasticity the structure of the cloth/fabric.

SUMMARY OF THE INVENTION

The aim of the present invention is to solve, among other things this problem. The present invention is based on the premise that the system should operate with small frictional forces for the warp threads during the greater part of each weaving cycle and that a friction counteracting the rubber band effect should be established during a part of each weaving cycle which is small enough not to cause any appreciably negative effects on the structure of the woven material.

The feature which can be principally regarded as characterizing the present invention is that, in connection with the interaction of the reed with each weft thread or weft threads, means are arranged to produce a momentary friction or increase in friction between the warp threads and a member arranged in the warp thread track or warp thread tracks between the magazine and the fell of the cloth in order to effect a reduction in the flexibility of the warp threads at the fell of the cloth during the interaction between the reed and the weft thread.

The present invention is preferably used in those weaving machines in which the warp thread track runs via one or more whip rolls and one or more auxiliary back beams. In one embodiment one whip roll can be used together with one auxiliary back beam. The whip roll and auxiliary back beam may alternatively be replaced by a member which is temporarily introduced into the warp thread track so that a change in the direction of the warp threads occurs. This means preferably consist of brake members which act on the whip roll or the auxiliary back beam and direction-changing members. The friction or the increase in friction is thus present when the brake members are activated, because the warp threads run with friction over the braked direction-changing member or the like, which in this case is stationary or is rotated by the warp threads at reduced speed. The friction or the increase in friction is not present when the brake members are deactivated, since the warp threads cause such a rotation of the direction-changing member or the like that no or only slight friction occurs between the warp threads and the direction-changing member or the like.

In the preferred embodiment the direction-changing member or the like is suspended in a storage function which facilitates the rotation. Alternatively, the direction-changing member can be assigned drive members which are controlled in such a way that relative member rotations occur in relation to the speed of the warp threads.

In the case where several direction-changing members are incorporated in the warp thread track, each direction-changing member is assigned its own controllable brake member. Each brake member can consist of a hydraulic brake member of known type. Each direction-changing member is preferably designed with brake discs which can cooperate with brake discs in a brake system in a known manner. Each brake member can be controlled by members determining or detecting the movements of the reed or weaving machine. For example, the drive shaft of the weaving machine can be used to effect the controls of each brake member. On the drive shaft of the weaving machine, on the reed etc., an electrical contact is arranged which is actuable for a predetermined period by the member for determining or detecting movements. Alternatively, a switch contact can be arranged for temporary actuation of the determining or detecting member, which switch contact is followed by a delay member which ensures that the control going to each brake member remains for the predetermined time during which each brake member is to be actuated.

These means are designed to cause friction or an increase in friction during the time in which the reed is located within a predetermined area in the vicinity of the fell of the cloth, for example within an area of 0–0.05 m, preferably within 0–0.02 m, from the fell of the cloth.

The brake members are preferably controlled by solenoid valves, for example solenoid valves with two positions.

ADVANTAGES

By means of what has been proposed, in known weaving machines the advantages with both rotating and non-rotating whip rolls and auxiliary back beams can be made use of, and at the same time the disadvantages of these units can be substantially reduced. The temporary friction/friction change/friction increase which is effected over a small part of each weaving pick can be achieved simply by other means, for example with a beam or tube which is momentarily brought into interaction with the warp threads, a change in the friction coefficient of the interaction track between each whip roll/auxiliary back beam and the warp threads, etc. Cloths and fabrics of very high quality can be woven in this way by virtue of what is proposed in the present invention.

The friction or the increase in friction is initiated in one embodiment at the middle parts of the warp thread track, which means that non friction-actuated parts of the warp thread track are reduced by about half. Moreover, tendencies towards resilience in the warp thread magazine itself can be eliminated. During ongoing weaving continuous brake signals are obtained at the slowly rotating direction-changing member(s) or the like, which thereby obtains a brake impulse during each turn and is stopped or has its speed reduced.

BRIEF DESCRIPTION OF THE DRAWINGS

An at present proposed embodiment of an arrangement, which exhibits the characteristics relevant to the invention, will be described below with simultaneous reference to the attached drawings, in which.

DETAILED DESCRIPTION OF THE PREFERRED EMBODIMENT

Figure 1:
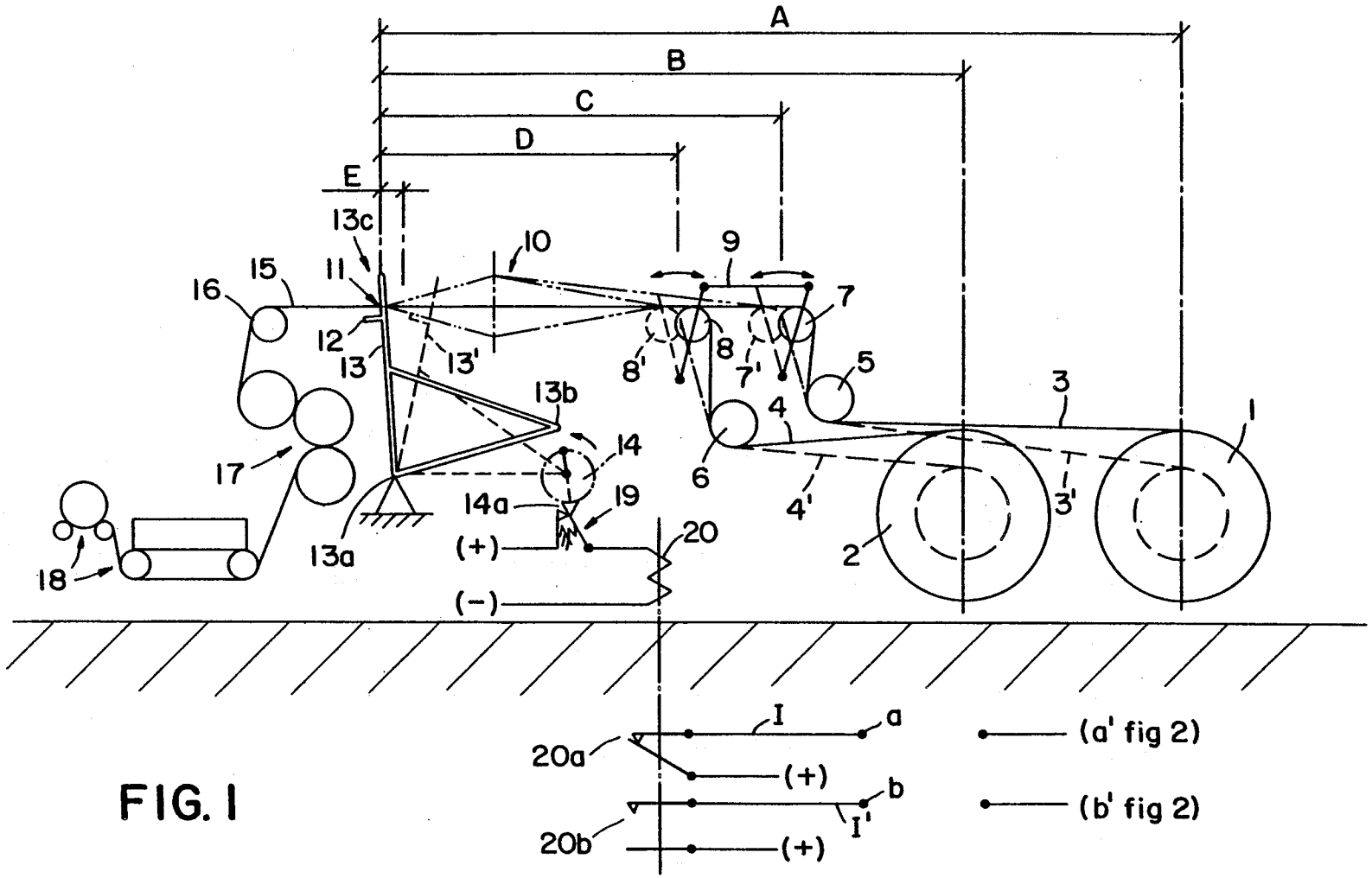
FIG. 1 shows a side view and skeleton diagram of parts, relevant to the invention, of a weaving machine known per se for weaving cloths.

The present invention can be used with, for example, the cloth weaving machine sold by Älmhults Bruks AB, Sweden, under the designation TEXO, whose parts relevant to the invention are shown in FIG. 1. These parts comprise two warp thread magazines (beams) 1 and 2, from which warp threads run in warp thread tracks 3 and 4. Each track is led via a auxiliary back beam 5 or 6 and a whip roll 7 or 8. The warp thread tracks between the magazine and the auxiliary back beams are shown in full lines 3, 4 and in broken lines 3', 4' in order to represent the feed from full and partially empty warp beams/magazines respectively. The whip rolls 7 and 8 have their movements coordinated with members 9 and are movably arranged between two end positions, one of which is shown with full lines 7, 8 and the other with broken lines 7', 8'.

From the whip rolls the warp thread tracks lead further towards the shed 10 and the fell of the cloth 11 which is established by means of one or more shuttles (not shown separately) whose associated shuttle race 12 is arranged on a reed 13 and follows the movements thereof towards and from the fell of the cloth. The frame of the reed is mounted rotatably at its lower front edge 13*a*. At its rear edge 13*b* the frame is acted on by a drive shaft 14 belonging to the weaving machine, so that, upon rotation of the drive shaft, rocking movements occur in the loom frame, and the movements to and from the fell of the cloth are obtained at the upper parts 13*c* of the reed.

At the fell of the cloth 11 a cloth or fabric 15 is thus present which comprises warp threads, which form longitudinal elements, and the threads (yarn) drawn in between the warp threads by the shuttles, which threads form transverse elements.

The fabric is passed from the fell of the cloths via a further breast beam 16 down towards a beam system 17 which serves as a pulling system for warp and fabric. From the beam system the fabric is passed further towards treatment and collection members (magazines) 18 for the finished-woven fabric.

The reed operates between two end positions, one of which is shown with full lines 13 and the other is shown with broken lines 13'. The auxiliary back beams 5 and 6 and the whip rolls 7 and 8 are rotatably mounted in ball bearings or the like and are caused to rotate by the warp threads 3, 4. The object of the whip rolls 7, 8 is to produce an essentially constant thread tension in the warp threads.

The tensile stress in the warp and fabric effected by the beam system 17 is of the order of magnitude of 15000 Newton/running meter (N/m). The reed presses in the weft thread(s) with pressing forces of about 30000 N/m. The length of the warp thread track between the magazines 1, 2 and the fell of the cloth 11 is shown by A and B respectively. The average distance between the whip rolls 7, 8 and the fell of the cloths 11 is shown by C and D. A can assume values of about 4.6 m and B values of about 3.6 m. The values for C are about 2.7 m and for D about 2.2 m.

It emerges from the above that, in the arrangement shown, resiliency tendencies can arise in the warp thread system when the reed strikes or presses in the weft thread or group of weft threads. The resiliency tendencies arise as a result of the elasticity in the warp threads themselves, elasticity resulting from the unwinding from the warp beams, the function of the shed frames, etc.

For the purpose of substantially reducing the warp thread length influencing the resilience and of eliminating the resiliency tendencies resulting from unwinding from the magazines 1 and 2, according to the invention a friction or increase in friction is applied in the contact between the whip roll 7, 8 and/or auxiliaty back beam 5, 6. The friction or the increase in friction means that the warp thread length, which was previously free of friction, or essentially free, is reduced to about half or to the distance C or D respectively. The elasticity or rubber band effect is thus reduced to that which may arise at the distance C or D, which is thus a considerable reduction.

The friction or the increase in friction is initiated by braking of each whip roll and/or auxiliary back beam. The whip roll or the auxiliary back beam rotates slowly. The roll or the beam executes, for example, one rotational turn in about 30 minutes. The braking time for each turn is about 0.2 sec which, in the preferred embodiment, means that the whip roll/auxiliary back beam are completely stopped, in which connection the warp thread slides towards the stationary whip roll/auxiliary back beam. Alternatively, the speed of the whip roll-/auxiliary back beam need only be reduced, for example to a rotation which lies within the range of extremely low speed and up to about half the rotation which is present in the non-braked state. As soon as the braking stops, the whip roll/auxiliary back beam are caused to move at the original speed of the warp threads, etc.

Brake signals are emitted to each back rest/breaking beam when the reed is located within the range E which is calculated from the fell of the cloth and back towards the whip rolls. The distance E is chosen within the range 0–0.05 m, preferably within the range 0–0.02 m. The brake signals are effected in the preferred embodiment by means of an electrical make contact which is actuated mechanically once per revolution of the drive shaft 14 via actuation member 14*a* on the latter. The contact 19 is designed so as to spring back, i.e. the contact is broken as soon as the actuation from the member 14*a* ceases in each rotation. When closed, the contact 19 activates a delay member (relay) 20 which operates with delayed disconnection. In the activated position the delay member emits a control signal I on a conductor a, and in the off position the delay member emits a reset signal I' on a conductor b.

Figure 2:
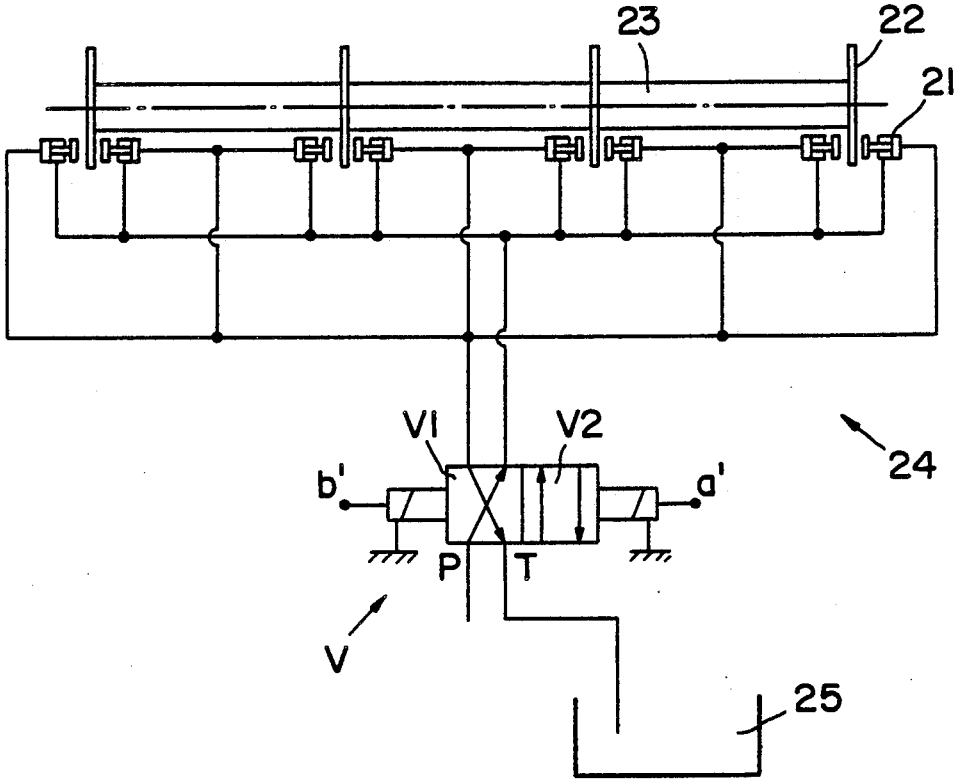
FIG. 2 shows a side view of brake members arranged on a direction-changing member which is arranged on or can be introduced into a warp thread track, for example in the form of a whip roll or an auxiliary back beam.

The conductors a and b are connectable to the coils of a two-way solenoid valve according to FIG. 2, which shows the valve in a starting position. In this position brake cylinders 21 actuable by a hydraulic system assume inactivated positions in which they do not bear against brake discs 22 arranged on the member 23 which may be the whip roll 7, 8 or the auxiliary back beam 5, 6 according to FIG. 1. The starting position is achieved by the top sides of the pistons of the brake cylinders being coupled to the pressure side P of the hydraulic system and the lower sides of the pistons are coupled to the return side T/sump. When the valve assumes its second (activated) position, the pressure P is conversely coupled to the top sides and the return side to the lower sides of the pistons, which means that the brake pistons are pressed against the discs and the brake system is thereby activated, etc. The connections of the magnet coils to the conductors a and b are shown by a' and b' respectively. The brake members have been shown in their entirety by 24 and the sump by 25. There are two brake cylinders 21 per brake disc 22 and, in the case shown, there are four brake discs per direction-changing member (whip roll/auxiliary back beam). Each whip roll/auxiliary back beam is provided in one embodiment with its own brake member 24.

The actuation member 14*a* acts on the electrical contact 19 which activates the delay member 20. This thereby keeps a first make contact 20*a* activated for a predetermined time which is chosen as a function of the rotational speed of the whip roll/auxiliary back beam. With the first contact 20*a* the valve V is kept in its activated position for the predetermined time. During its activation the delay member 20 moreover keeps a second electrical make contact 20*b* broken. After the delay time, the contact 20*a* is broken and the contact 20*b* is closed, in which connection the valve assumes its starting position where the brake members 24 are deactivated. The valve assumes its starting position until such time as the actuation member 14*a* again acts upon the contact 19, etc.

The present invention is not limited to the embodiment shown above by way of example, but can undergo modifications within the scope of the subsequent patent claims and the inventive concept.

I claim:

1. A braking device for use in a weaving machine which operates with at least one warp thread track leading from warp thread magazines towards a shuttle race plate at which a fell of a cloth is established and weft threads are drawn in with a reed during ongoing weaving, said device including;

means for producing a momentary friction or increase in friction between the warp thread and a rotatable member for changing the direction of the warp thread track which is arranged in the warp thread track between the magazine and the fell of the cloth in order to effect, during the interaction between the reed and the weft thread a reduction in the flexibility of the warp thread at the fell of the cloth;

said means including controllable brake members which, in response to control signals, interact with said member for changing the direction of the warp thread track, such that the friction or the increase in friction is present when the brake members are activated, causing the warp thread to run with friction over the braked member for changing the direction, wherein said direction changing member is held by said brake member to be stationary or to be rotated at a reduced speed, and the friction or the increase in friction is not present when the brake members are deactivated, since the warp thread causes such a rotation of the member for the changing direction that none or only slight friction occurs between the warp thread and the direction-changing member.

2. A device according to claim 1, wherein in the warp thread track said controllable brake members are arranged to interact with a whip roll and/or an auxiliary back beam constituting said direction changing member.

3. A device according to claim 2, wherein said controllable brake members comprise two manoeuvering valves (V), and wherein the whip roll and the auxiliary back beam are each assigned a maneuvering valve.

4. A device according to claim 3, wherein the whip roll and/or the auxiliary back beam is/are designed with brake discs through which braking of the whip roll and the auxiliary back beam is carried out with the brake members.

5. A device according to claim 2, wherein the whip roll and/or the auxiliary back beam is/are provided with brake discs, through which braking of the whip roll and the auxiliary back beam is carried out with the brake members.

6. A device according to claim 2, wherein the brake members consist of hydraulic brakes which are each controllable by a solenoid valve constituting said maneuvering valve.

7. A device according to claim 2, wherein said means are designed to cause friction or an increase in friction during the time in which the reed is located in the vicinity of the fell of the cloth within the range 0–0.02 m from the fell of the cloth.

8. A device according to claim 5, wherein the brake members consist of hydraulic brakes which are each controllable by a solenoid valve constituting said maneuvering valve.

9. A device according to claim 1, wherein, the brake members are controlled by a member determining movements of the reed.

10. A device according to claim 1, wherein said means are designed to cause said friction or increase in friction during the time in which the reed is located in the vicinity of the fell of the cloth within the range 0–0.02 m from the fell of the cloth.

11. A device according to claim 10, wherein the brake members are controllable by means of an electrical contact adapted to ensure, by means of a delay member, the friction or increase in friction for a predetermined time.

12. A device according to claim 1, wherein the brake members are controlled with a member detecting movements of the reed.

13. A device according to claim 1, wherein the brake members are controllable by means of an electrical contact by means of a delay member, to ensure the friction or friction increase for a predetermined time.

14. A device according to claim 1, wherein the brake members are controlled by a member detecting movements of the weaving machine.

15. A device according to claim 2, wherein the brake members are controlled by a member determining movements of the weaving machine.

* * * * *